US008979199B2

(12) United States Patent
Ko

(10) Patent No.: US 8,979,199 B2
(45) Date of Patent: Mar. 17, 2015

(54) CHAIR WITH PRE-STRESSING STRUCTURE

(76) Inventor: Wen-Shan Ko, Tainan County (TW)

( * ) Notice: Subject to any disclaimer, the term of this patent is extended or adjusted under 35 U.S.C. 154(b) by 280 days.

(21) Appl. No.: 13/546,278

(22) Filed: Jul. 11, 2012

(65) Prior Publication Data

US 2012/0274112 A1 Nov. 1, 2012

Related U.S. Application Data

(63) Continuation-in-part of application No. 12/509,461, filed on Jul. 25, 2009, now abandoned.

(51) Int. Cl.
*A47C 1/024* (2006.01)
*A47C 7/44* (2006.01)

(52) U.S. Cl.
CPC ..... *A47C 7/448* (2013.01)
USPC ..... 297/301.3; 297/301.5; 297/291; 297/292; 297/293

(58) Field of Classification Search
CPC ..... A47C 7/44; A47C 7/448; A47C 3/0252
USPC ..... 297/291–293, 301.3, 301.5; 403/146
See application file for complete search history.

(56) References Cited

U.S. PATENT DOCUMENTS

| | | | | |
|---|---|---|---|---|
| 3,881,772 | A * | 5/1975 | Mohrman | 297/300.4 |
| 5,524,966 | A | 6/1996 | Piretti | |
| 5,957,533 | A * | 9/1999 | Gallardo | 297/301.1 |
| 6,585,320 | B2 * | 7/2003 | Holbrook et al. | 297/300.4 |
| 6,682,252 | B2 | 1/2004 | Battey et al. | |
| 7,243,993 | B2 * | 7/2007 | Igarashi et al. | 297/300.4 |
| 7,325,873 | B2 * | 2/2008 | Stewart et al. | 297/301.3 |
| 7,568,763 | B2 * | 8/2009 | Bedford et al. | 297/300.1 |

FOREIGN PATENT DOCUMENTS

| | | | | |
|---|---|---|---|---|
| DE | 3203042 | A1 * | 10/1982 | A47C 5/06 |

* cited by examiner

*Primary Examiner* — David R Dunn
*Assistant Examiner* — Tania Abraham
(74) *Attorney, Agent, or Firm* — Egbert Law Offices, PLLC

(57) ABSTRACT

A chair with a pre-pressing structure includes a chair body and a pre-pressing structure enabling the chair body to be provided with elastic restoring force. The chair is characterized in that the pre-pressing structure includes a pre-pressing member's fixed seat, a pre-pressing member, a pivoting seat, a pre-pressing positioning member and a pre-pressing angle.

4 Claims, 7 Drawing Sheets

CHAIR WITH PRE-STRESSING STRUCTURE

CROSS-REFERENCE TO RELATED U.S. APPLICATIONS

The present application is a continuation-in-part of U.S. patent application Ser. No. 12/509,461 filed on Jul. 25, 2009, now abandoned and entitled "Chair with Pre-stressing Structure."

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a chair, and more particularly to an innovative one which is designed with a pre-pressing structure.

2. Description of Related Art Including Information Disclosed Under 37 CFR 1.97 and 37 CFR 1.98

At present, there are various types of chairs that are functionally designed to meet ergonomic requirements for improved comfort. Since the seat cushion and back of common chairs are assembled securely, the chair back becomes a fixed part. In such a case, the users have to take a fixed sitting posture, leading to discomfort when sitting for a longer time. To overcome the aforementioned problems, a chair with an elastic structure has recently been developed, i.e.: an elastic structure is set at the assembly portion of the cushion and back of chair, so that the back of chair can be tilted back and rebounded via the elastic structure.

However, some shortcomings of the structural design of said chair with elastic structure are still observed, wherein the elastic structural design is a crucial influential factor. Elastic fatigue cannot be resisted in a conventional structural design, leading to shorter service life of the chair. Thus, it would be an advancement in the art to provide an improved device that can be advantageous to users.

Moreover, a chair with an elastic structure at the joint has been developed in prior art, as illustrated by U.S. Pat. No. 6,682,252, wherein a torsion tube is assembled at the preset joint of the chair, and then a set of bolts and nut positioning members are meshed with the tooth, so that the joint and torsion tube could be assembled together in a limited condition. Meanwhile, when the joint generates pivotal motion, the torque tube will be twisted to accumulate resetting elasticity. Yet, it is found in practical applications that owing to numerous components, the installers must consider the relationship among so many components such as: some parts corresponding to the joint, torsion tube and bolt and nut positioning members. And they may be assembled using other special toolkits. Hence, some problems and shortcomings, e.g.: difficult and time-consuming assembly and higher manufacturing cost, need to be overcome.

Thus, to overcome the aforementioned problems of the prior art, it would be an advancement if the art to provide an improved structure that can significantly improve the efficacy.

Therefore, the inventor has provided the present invention of practicability after deliberate experimentation and evaluation based on years of experience in the production, development and design of related products.

BRIEF SUMMARY OF THE INVENTION

Based on above-specified structural design, the present invention is operated as follows:

The core aspect disclosed in the present invention mainly lies in the assembled pattern of the pre-pressing structure 20. According to the assembly steps shown in FIGS. 4, 5 and 6, firstly the pre-pressing member 22 and the pivoting seat 23 are assembled. When the pre-pressing member 22 is intended to be set into the pivoting seat 23, the embedded section 224 on the end of the multi-segment directional lug 223 will be firstly embedded into the multi-segment directional groove 233 for the purpose of orientation (as shown in FIG. 6). However, the embedding angle between the positioning convex part 31 and the calking groove 32 is not yet aligned due to the design of the pre-pressing angle (X), so embedding cannot be realized. Then, referring to FIGS. 7, 8 and 9, an external force (indicated by arrow L1 in FIG. 7) shall be applied to the limiting seat 221, making it swing to an angle for complete alignment of the positioning convex part 31 and embedding into (indicated by arrow L2 in FIG. 7) the calking groove 32 for a positioning state. When the limiting seat 221 is swung, the multi-segment directional lug 223 is embedded so that the cyclic elastic member 222 is twisted to accumulate elasticity (due to reverse stress for its inside and outside), so as to achieve elastic pre-pressing effect. When the bearing seat 11 (back or seat cushion) of the chair 10 swings elastically (indicated by arrow L3 in FIG. 11), this could provide better elasticity and longer service life.

Referring also to FIG. 10, the other side of the pre-pressing member 22 is assembled into the holding space 210 of pre-pressing member's fixed seat 21, then the assembly of pre-pressing structure 20 has been completed. Furthermore, the assembly status of the pre-pressing structure 20 could be fixed by the screwing of the bolt 41 and nut 42, so as to mate with the corresponding components of the chair. However, said bolt 41 and nut 42 are not an integral part for the pre-pressing structure 20, but positioning members previously set on the chair's joint. According to the description mentioned above, the pre-pressing structure 20 comprises of fairly simple components. There are only three separate components required to be assembled, of which the pre-pressing member's fixed seat 21 is directly installed on the bearing seat 11 of the chair body 10. The pivoting seat 23 is directly inserted into the supporting member 12 of chair body 10. Another independent component is pre-pressing member 22; the elastic pre-pressing effect is formed in a way that when the embedded section 224 located on the end of the multi-segment directional lug 223 is firstly embedded into the multi-segment directional groove 233, a force is further applied to the limiting seat 221, making it swing to an angle for the embedding of the positioning convex part 31 into the calking groove 32 for elastic pre-pressing effect. Hence, the assembly process of the pre-pressing structure 20 is quite simple without any components' complex mating relation, and there is also no need of other tools for the benefit of ordinary people.

The pre-pressing structure of the present invention could be installed on the back of chair. In the embodiments, when a user leans on the back of chair, the positioning convex part 31 of the positioning member 30 will swing along with the varying inclination angle of the back of chair, and the cyclic elastic member 222 is twisted to accumulate elasticity. When the user's back leaves the back of chair, the positioning convex part 31 will drive the back of chair to be reset via the elastic resetting force of the cyclic elastic member 222, making the user feel comfortable. Of which, said calking groove 32 is wider than the positioning convex part 31, so there is a displacement space for said positioning convex part 31 in the calking groove 32, and the maximum inclination angle of the back of chair could be limited (indicated by arrow L3 in FIG. 11).

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
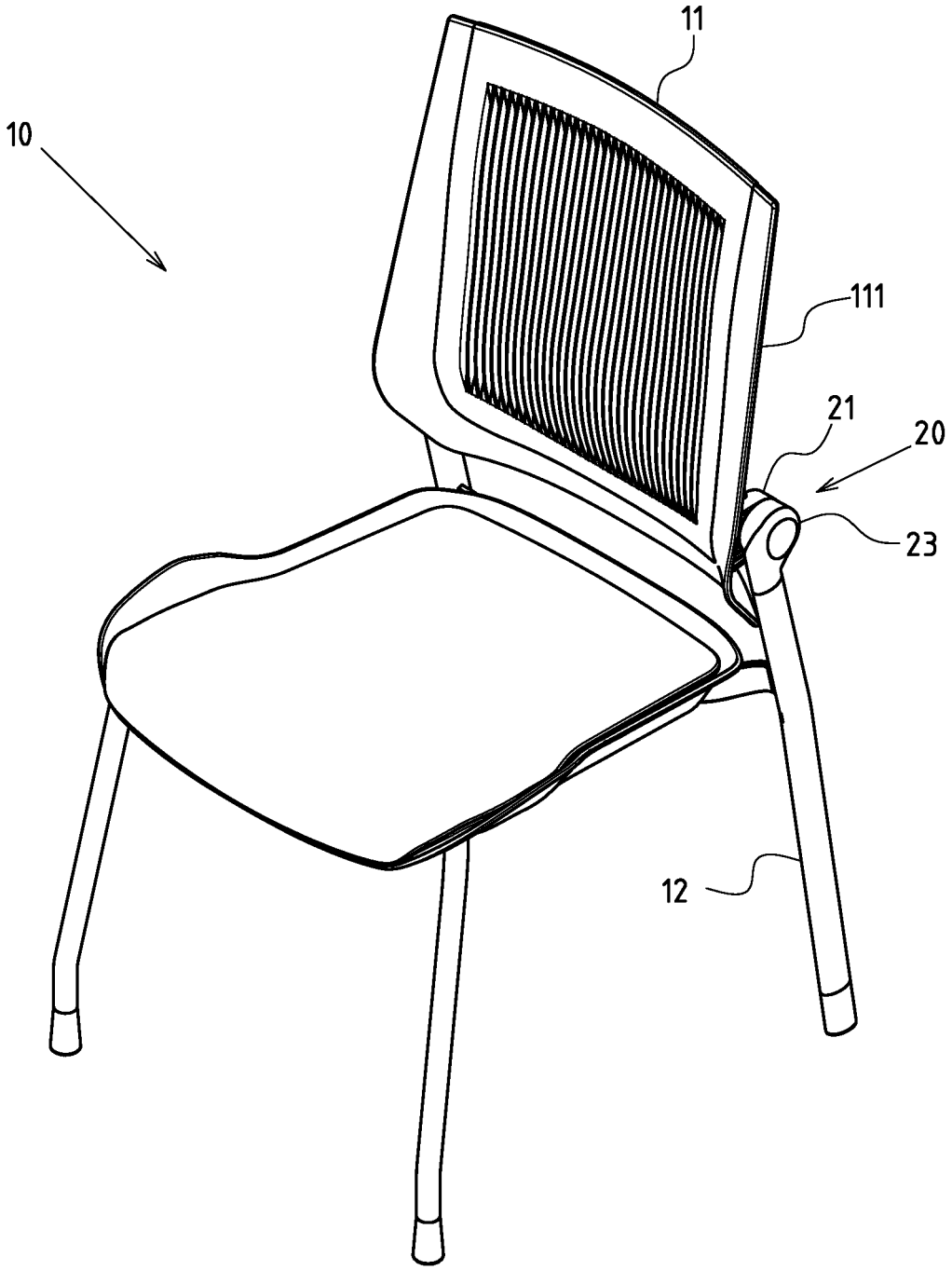
FIG. 1 is an assembled perspective view of the present invention wherein the pre-pressing structure is applied to a chair.
Figure 2:
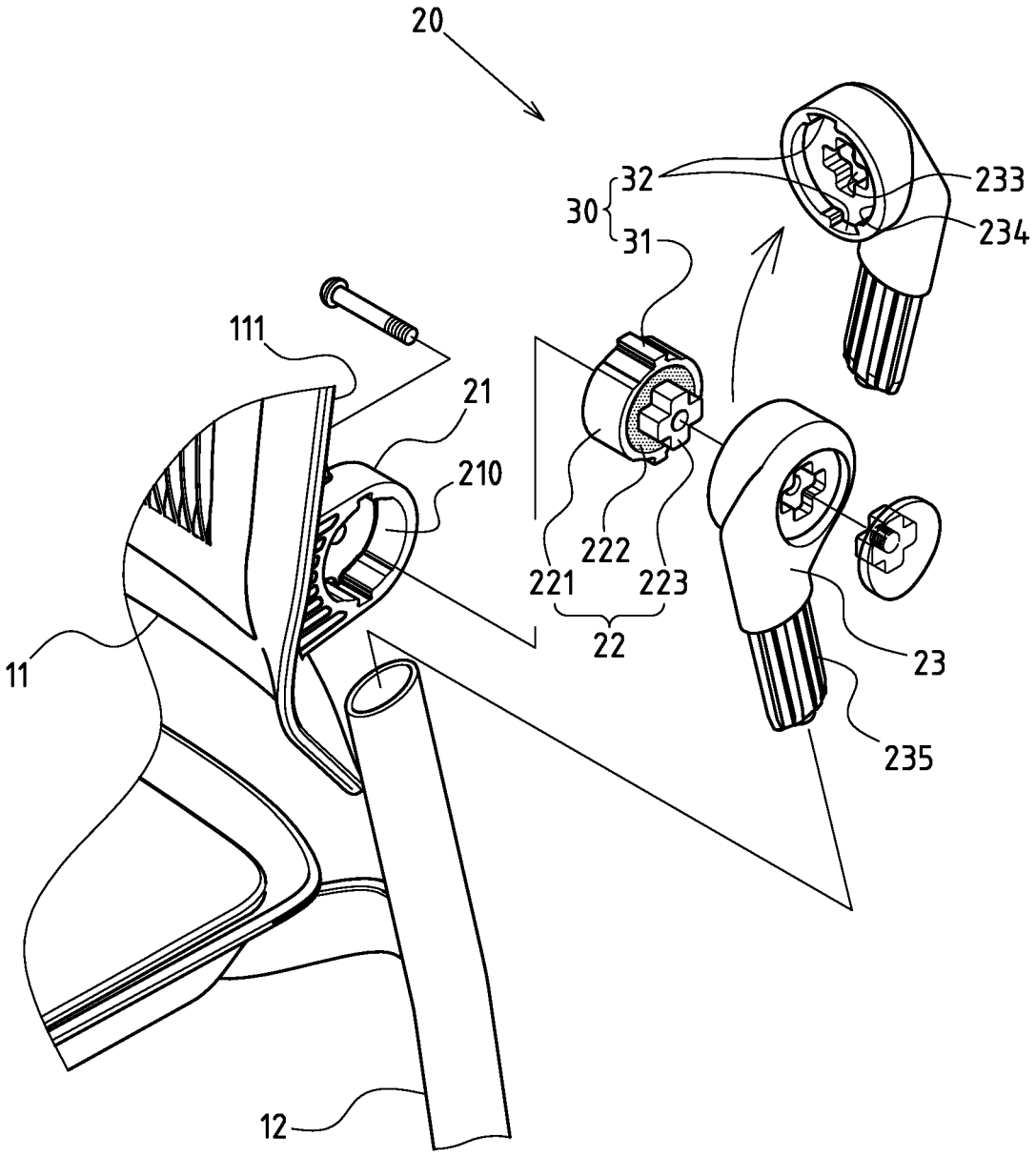
FIG. 2 is an exploded perspective view of the pre-pressing structure of the present invention.
Figure 3:
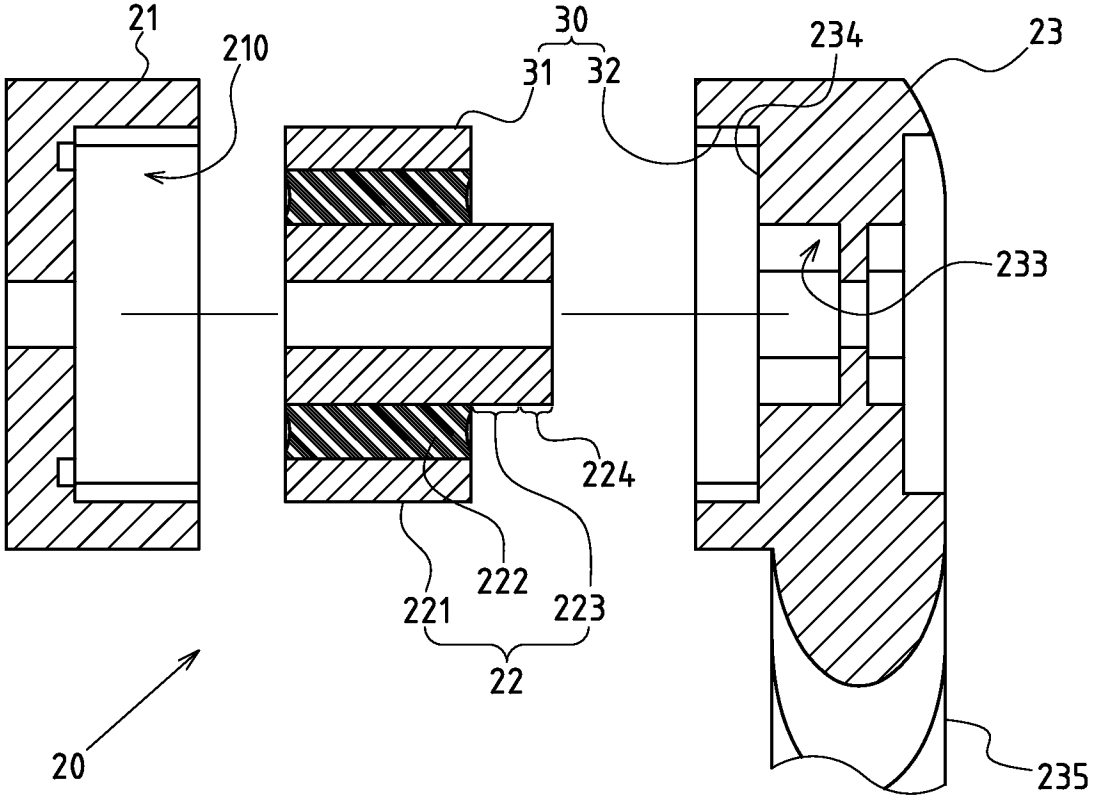
FIG. 3 is an exploded sectional view of the pre-pressing structure of the present invention.
Figure 4:
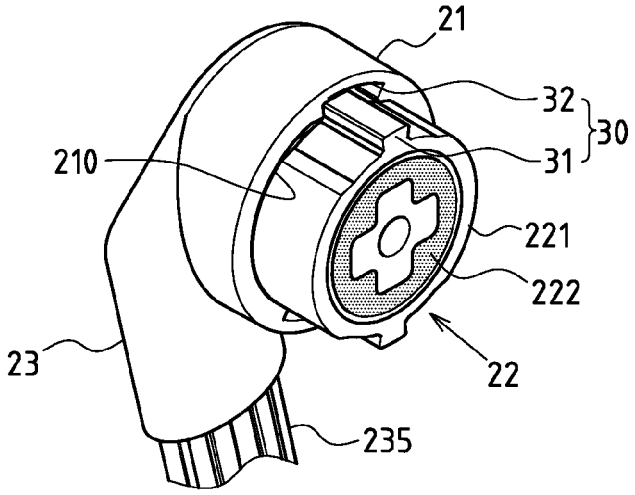
FIG. 4 is a perspective view of assembly step 1 of the pre-pressing structure of the present invention.
Figure 5:
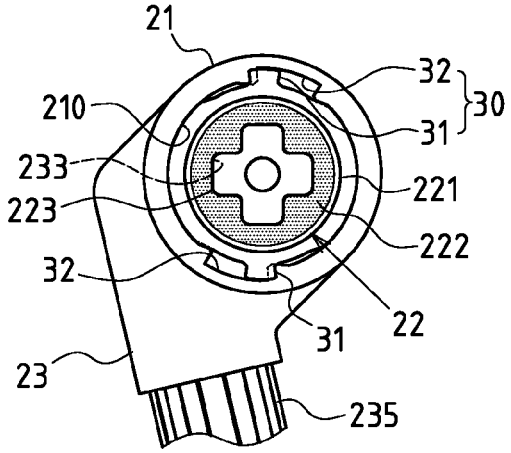
FIG. 5 is a plan view of assembly step 1 of the pre-pressing structure of the present invention.
Figure 6:
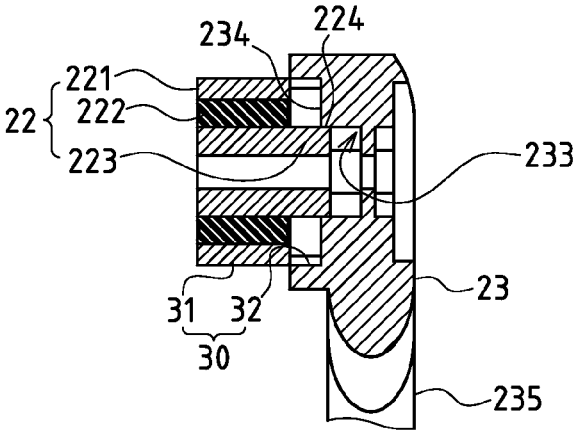
FIG. 6 is a sectional view of assembly step 1 of the pre-pressing structure of the present invention.
Figure 7:
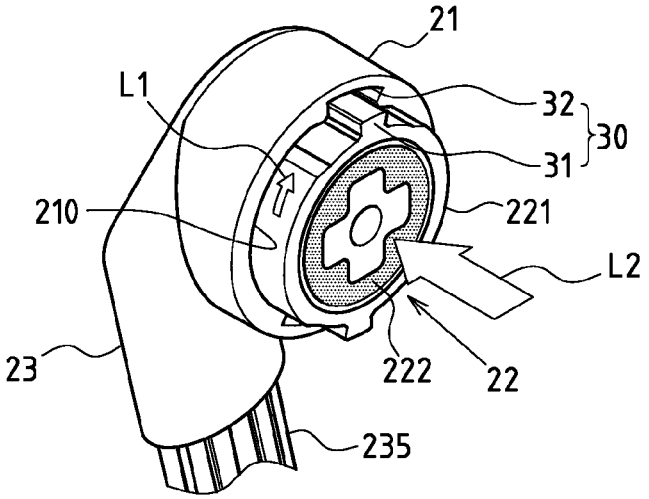
FIG. 7 is a perspective view of assembly step 2 of the pre-pressing structure of the present invention.
Figure 8:
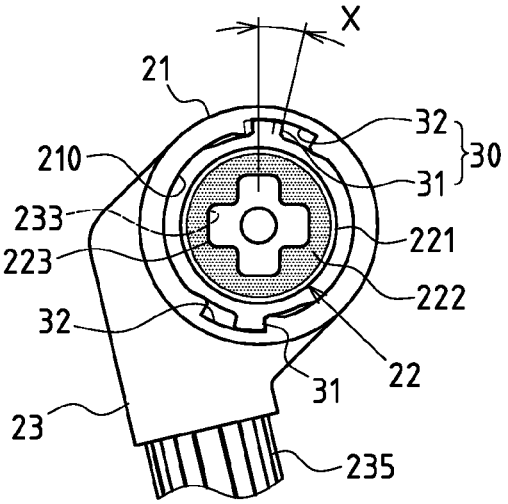
FIG. 8 is a plan view of assembly step 2 of the pre-pressing structure of the present invention.
Figure 9:
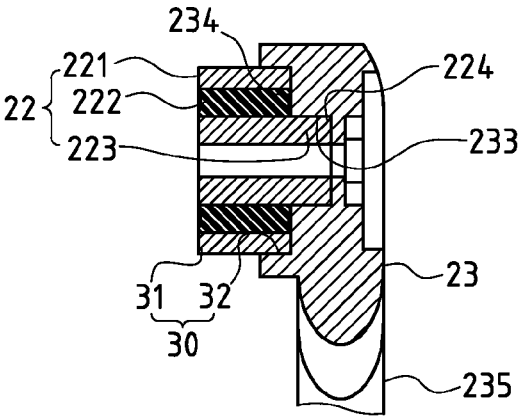
FIG. 9 is a sectional view of assembly step 2 of the pre-pressing structure of the present invention.
Figure 10:
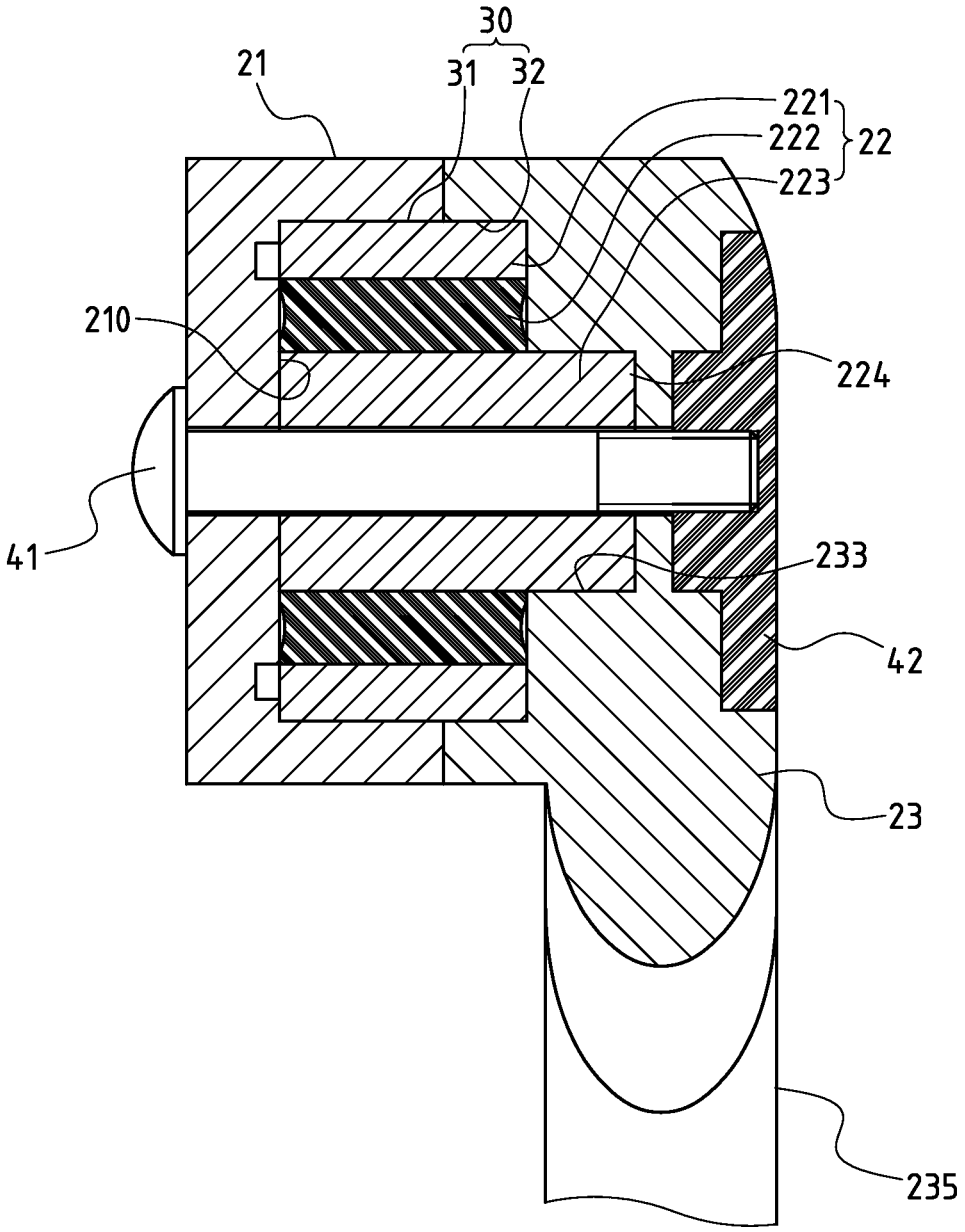
FIG. 10 is an assembled sectional view of the pre-pressing structure of the present invention.
Figure 11:
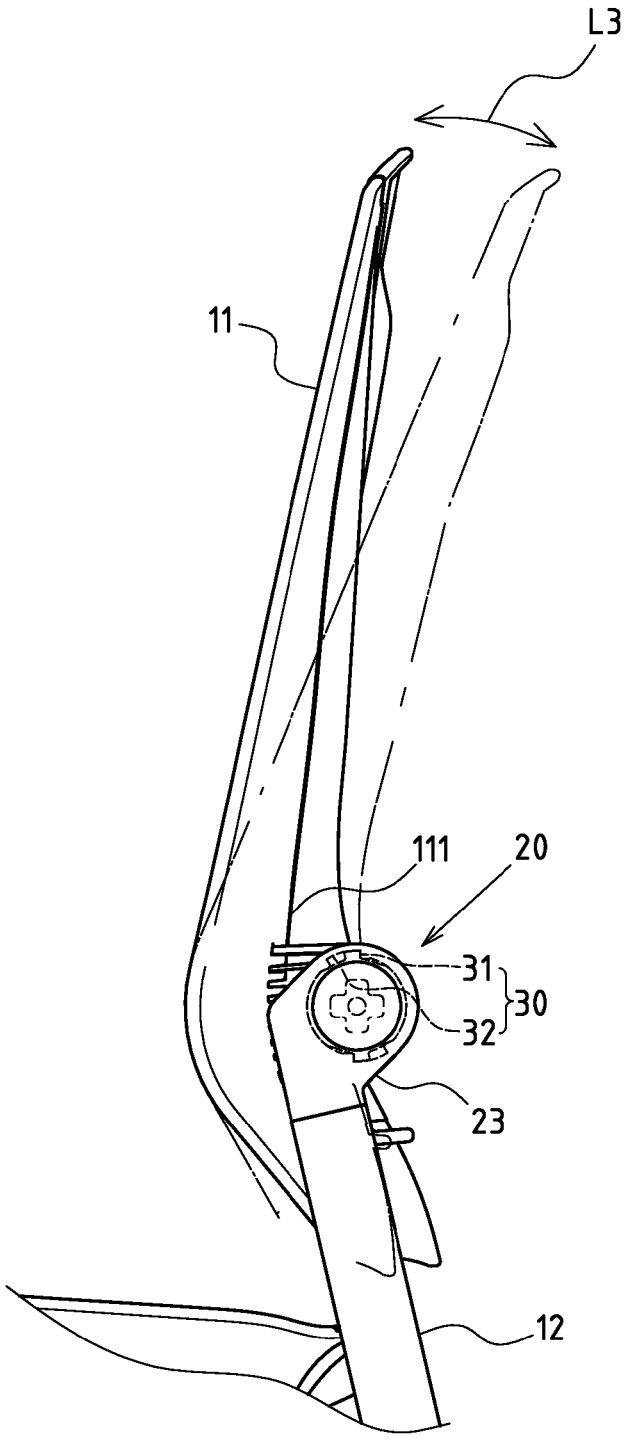
FIG. 11 is a plan side view of the present invention wherein the pre-pressing structure allows the bearing seat of chair to swing elastically.

FIGS. 1, 2, 3 and 10 depict the preferred embodiments of the chair with pre-pressing structure, which, however, are provided for only explanatory objective for patent claims; said chair comprising:

a chair body 10, comprising of at least a bearing seat 11 fitted with a mounting surface 111 and a supporting member 12;

at least a pre-pressing structure 20, enabling the chair body 10 to be provided with elastic restoring force; the pre-pressing structure 20 comprising:

at least a pre-pressing member's fixed seat 21, which is located on the mounting surface 111 of the bearing seat 11 and provided with a holding space 210;

at least a pre-pressing member 22, which is assembled in the holding space 210 of the pre-pressing member's fixed seat 21; the pre-pressing member 22 comprises of a limiting seat 221, a cyclic elastic member 222 and a multi-segment directional lug 223 protruded at one side of the center of said cyclic elastic member 222;

an embedded section 224, which is formed on the end of the multi-segment directional lug 223;

a pivoting seat 23, which is provided with a multi-segment directional groove 233 to be mated with the multi-segment directional lug 223. A grooved portion 234 is formed externally onto the multi-segment directional groove 233. The pivoting seat 23 is also provided with an inserting part 235 for inserting into the supporting member 12 of the chair body 10;

a pre-pressing positioning member 30, which is composed of at least a positioning convex part 31 set on the limiting seat 221 and at least a calking groove 32 of the grooved portion 234 set on the pivoting seat 23; of which, the calking groove 32 is wider than the positioning convex part 31, so that there is a displacement space for said positioning convex part 31 in the calking groove 32;

a pre-pressing angle (X), which permits the embedding angle between the multi-segment directional groove 233 and multi-segment directional lug 223 to vary from that between the positioning convex part 31 and the calking groove 32, as shown in FIG. 8.

With the setting of the pre-pressing angle (X), when the pre-pressing member 22 and the pivoting seat 23 are assembled, the embedded section 224 located on the end of multi-segment directional lug 223 will be embedded into the multi-segment directional groove 233 for the purpose of orientation. As the embedding angle between the positioning convex part 31 and the calking groove 32 is not yet aligned, an external force shall be applied to the limiting seat 221, making it swing to an angle for embedding. When the limiting seat 221 is swung, the multi-segment directional lug 223 is embedded so that the cyclic elastic member 222 is twisted (note: due to reverse stress for its inside and outside) to accumulate elasticity, realizing elastic pre-pressing effect.

Of which, the bearing seat 11 could be applied to either the back or seat cushion of the chair 10. The figures illustrated in the present invention depict the embodiment applied onto the back of chair.

Of which, the multi-segment directional lug 223 and the multi-segment directional groove 233 could be of either cross-shaped (shown in FIG. 2) or polygonal pattern.

I claim:

1. A chair comprising:

a chair body having at least one bearing seat fitted with a mounting surface and a supporting member; and at least one pre-pressing structure so as to enable the chair body to have an elastic restoring force, the pre-pressing structure comprising:

a fixed seat located on said mounting surface of said chair body, said fixed seat having a holding space;

a pre-pressing member located in said holding space of said fixed seat, said pre-pressing member having a limiting seat and a cyclic elastic member and a multi-segment directional lug protruded at one side of a center of said cyclic elastic member;

an embedded section formed on an end of said multi-segment directional lug;

a pivoting seat having a multi-segment directional groove mated with said multi-segment directional lug, a grooved portion is formed externally onto said multi-segment directional groove, said pivoting seat having an inserting part for inserting into said supporting member of said chair body;

a pre-pressing positioning member having at least one positioning convex part positioned on said limiting seat and at least one calking groove of said grooved portion positioned on said pivoting seat, said calking groove being wider than the positioning convex part so as to provide a displacement space for said positioning convex part in said calking groove; and a pre-pressing angle so as to allow an embedding angle between said multi-segment directional groove and multi-segment directional lug to vary between said positioning convex part and said calking groove, said embedded section located on said end of multi-segment directional lug is embedded into said multi-segment directional groove, said pivoting seat swinging to an angle for embedding when a external force is applied thereto, said multi-segment directional lug being embedded such that said cyclic elastic member is twisted to accumulate elasticity when said pivoting seat is swinging.

2. The chair of claim 1, wherein said multi-segment directional lug and said multi-segment directional groove are of a cross-shaped pattern.

3. The chair of claim 1, wherein said multi-segment directional lug and said multi-segmental groove are of a polygonal shape.

4. The chair of claim 1, wherein said bearing seat is applied to either said back or a seat cushion of said chair body.

* * * * *